US005630333A

United States Patent [19]

Yanagimoto

[11] Patent Number: 5,630,333

[45] Date of Patent: May 20, 1997

[54] APPARATUS FOR BENDING BLADE MATERIAL

[75] Inventor: Chuji Yanagimoto, Yao, Japan

[73] Assignee: Itami Industrial Co., Ltd., Yao, Japan

[21] Appl. No.: 513,506

[22] Filed: Aug. 10, 1995

[30] Foreign Application Priority Data

| | | | |
|---|---|---|---|
| Aug. 20, 1994 | [JP] | Japan | 6-011378 U |
| Aug. 20, 1994 | [JP] | Japan | 6-218215 |

[51] Int. Cl.[6] ..... B21D 5/04

[52] U.S. Cl. ..... 72/14.8; 72/307

[58] Field of Search ..... 72/301, 298, 307, 72/311, 319, 14.8

[56] References Cited

U.S. PATENT DOCUMENTS

| | | | |
|---|---|---|---|
| 1,628,581 | 5/1927 | Dinkel | 72/298 |
| 1,783,177 | 12/1930 | Luce | 72/311 |
| 2,958,361 | 11/1960 | Hunter | 72/301 |
| 5,463,890 | 11/1995 | Tachibana | 72/307 |

FOREIGN PATENT DOCUMENTS

| | | | |
|---|---|---|---|
| 919935 | 3/1947 | France | 72/298 |
| 1029352 | 6/1953 | France | 72/311 |
| 226351 | 8/1994 | Japan | 72/307 |

*Primary Examiner*—Daniel C. Crane

*Attorney, Agent, or Firm*—Armstrong Westerman Hattori McLeland & Naughton

[57] ABSTRACT

The invention relates to an apparatus for automatically bending a strip-shaped blade material to a predetermined configuration. An oscillating arm provided with a movable clamp portion for holding the blade material at the front end portion thereof is attached to a base. A pair of stationary bits are adjacently placed on the base near an end of the movable clamp portion of the oscillating arm at a predetermined distance. The apparatus is provided with an oscillation driving mechanism oscillating the oscillating arm horizontally and a feeding mechanism sending the blade material forward along the oscillating arm. The blade material is bent between one of the stationary bits and the movable clamp portion by oscillating the oscillating arm horizontally.

32 Claims, 14 Drawing Sheets

APPARATUS FOR BENDING BLADE MATERIAL

BACKGROUND AND SUMMARY OF THE INVENTION

The present invention relates to an apparatus for bending a strip-shaped blade material.

A trimming die blade material for punching paper material such as cardboard into a predetermined configuration is manufactured by bending a strip-shaped blade material to a predetermined configuration. One of the most widely known apparatuses to be used in this bending process is a manual bending apparatus which is arranged to hold a blade material between a stationary bit fixed on a base and a movable bit which movement is operated through a lever and bend the blade material.

In using these conventional bending apparatuses, blade materials are bent manually, therefore their bending efficiency is not sufficient. Moreover, it is difficult to bend thick or wide blade materials with these conventional apparatuses. Besides, these apparatuses need to be operated by skilled workers in order to bend blade materials accurately.

It is therefore an object of the present invention to provide an apparatus for bending blade material which automatically bends blade material with accuracy and is simple in construction and easily manufactured.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
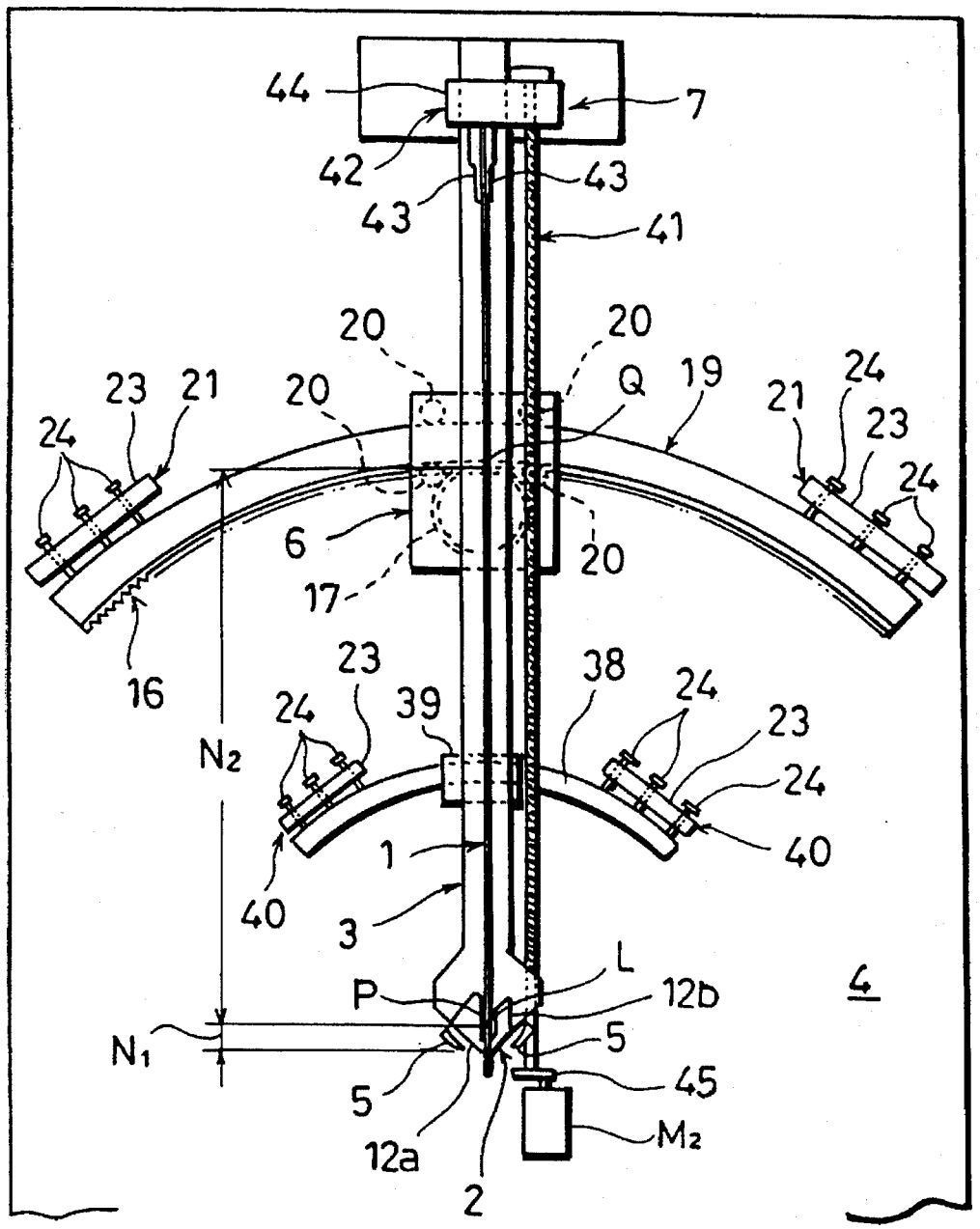
FIG. 1 is a schematic top plan view of a first embodiment of an apparatus for bending blade material according to the present invention.

FIG. 1 shows a first embodiment of an apparatus for bending blade material according to the present invention, and this apparatus is used in order to bend a strip-shaped blade material to a predetermined configuration and form a trimming die that punches paper material (for example, corrugated cardboard) into a predetermined configuration. The apparatus for bending blade material is provided with an oscillating arm 3 having a movable clamp portion 2, which freely fixes and releases a strip-shaped blade material 1, at the front end portion thereof, a pair of stationary bits 5 placed on a base 4 and near an end of the movable clamp portion 2 of said oscillating arm 3, an oscillation driving mechanism 6 that oscillates the oscillating arm 3 toward left and right in order to bend the blade material 1 between the stationary bits 5 and the movable clamp portion 2, and a feeding mechanism 7 sending the blade material 1 forward along the oscillating arm 3.

Figure 2:
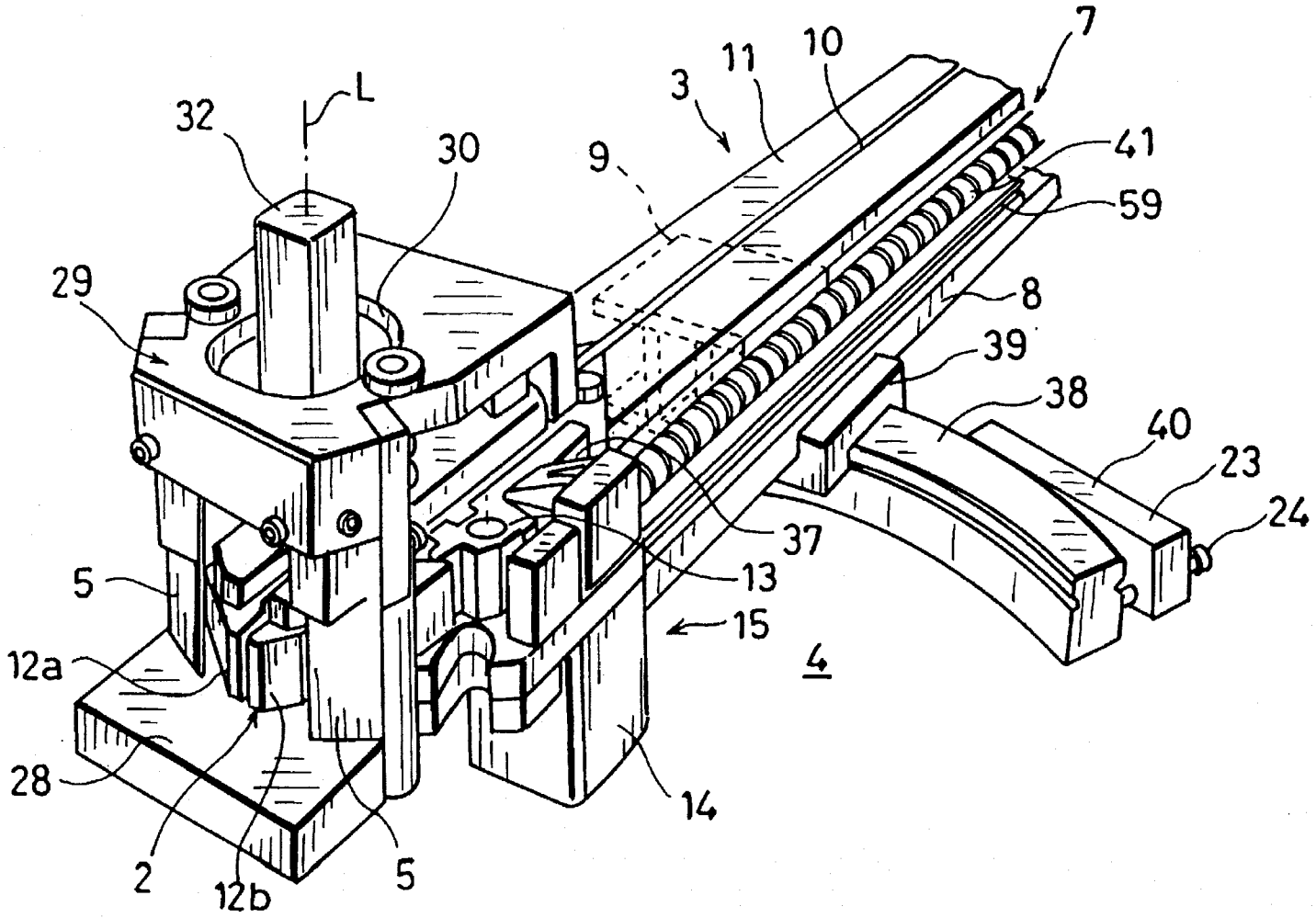
FIG. 2 is an enlarged perspective view of a principal portion of the apparatus for bending blade material of FIG. 1.
Figure 3:
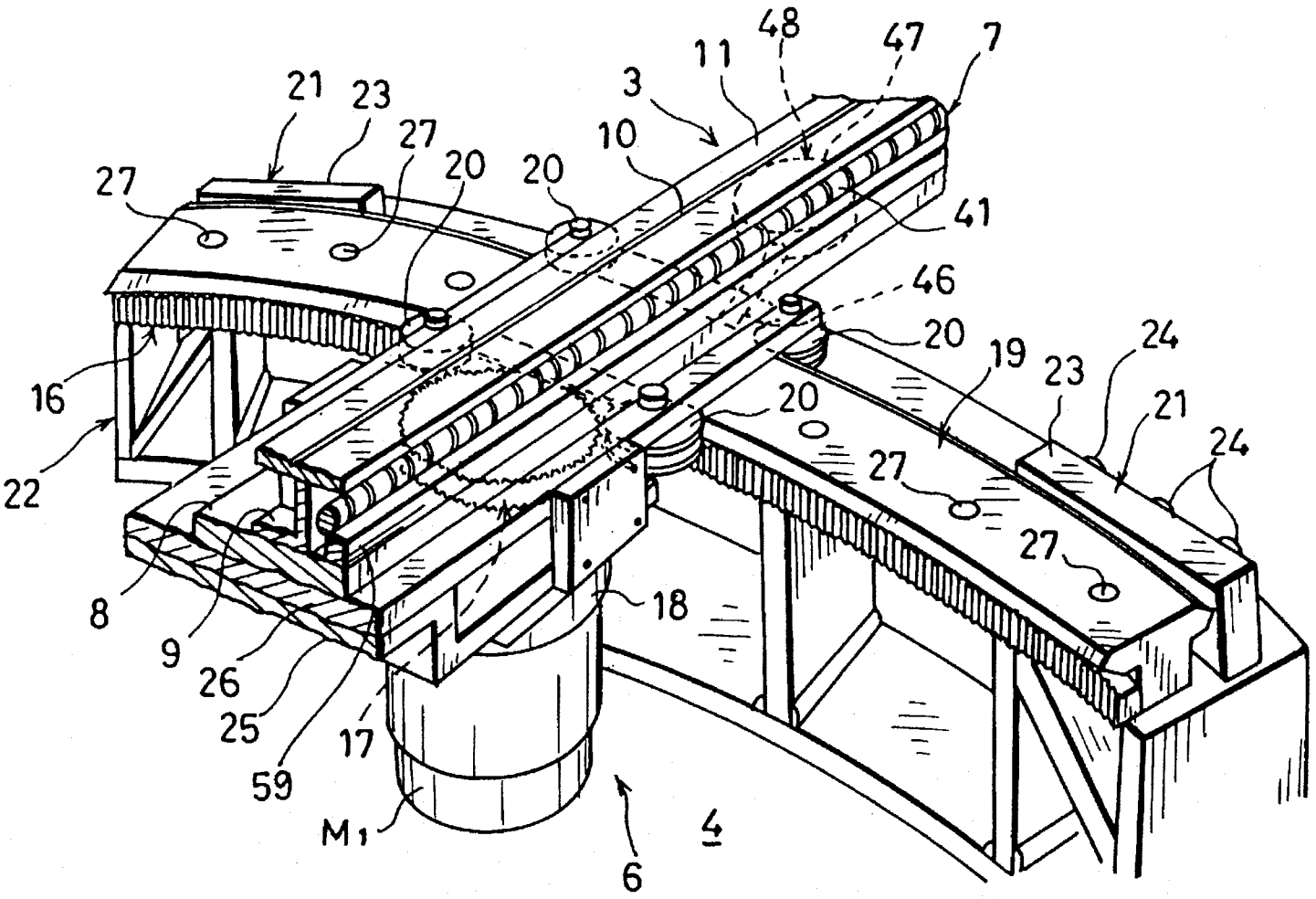
FIG. 3 is an enlarged perspective view of a principal portion of the apparatus for bending blade material of FIG. 1.

The oscillating arm 3 is placed on the base 4 and freely rotates on a vertical axis L with a portion slightly backward from the movable clamp portion 2 as the center of pivot. As shown in FIG. 2 and FIG. 3, the oscillating arm 3 possesses a horizontal strip-shaped base plate 8, spacer members 9 placed at predetermined positions on the base plate 8, and a strip-shaped guide plate 11 arranged to be above and parallel with the base plate 8 through the spacer members 9 and provided with a groove portion 10 for guiding blade material on the upper surface thereof.

Figure 4:
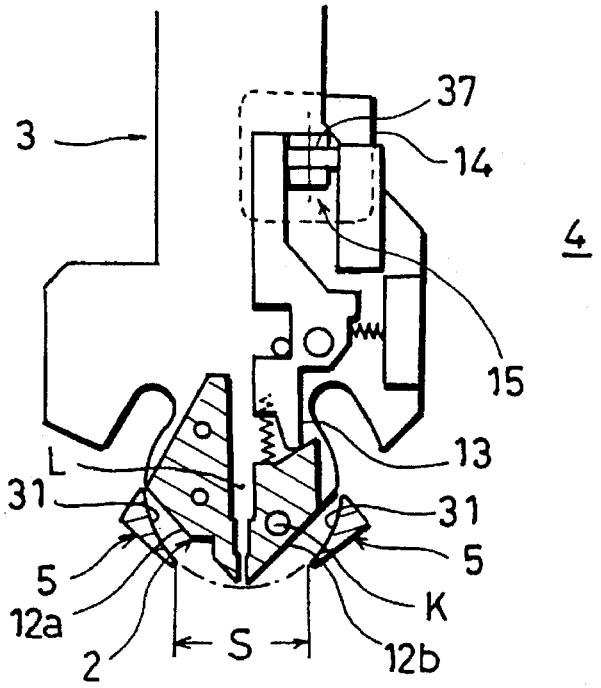
FIG. 4 is a schematic top plan view of a principal portion of the apparatus for bending blade material of FIG. 1.

As shown in FIG. 2 and FIG. 4, the movable clamp portion 2 consists of adjoining clamp clicks **12*a* and 12*b* placed at an end of the oscillating arm 3. The clamp click 12*a* is fixed at the end of the oscillating arm 3, and the clamp click 12*b* is attached to the end of the oscillating arm 3 and freely oscillates on a vertical axis K. A driving mechanism 15 is placed at the rear of the clamp click 12*b*, and the driving mechanism 15 is provided with an oscillating piece 13 touching a taper face at the rear end of the clamp click 12*b* and opening and closing the clamp click 12*b*, a toggle 37 oscillating the oscillating piece 13, and a cylinder 14 ascending and descending the toggle 37**.

The stationary bits 5 are fixed at the left and right end portions of a front table 28 located on the base 4 so that the stationary bits 5 keep a predetermined mutual distance S on the base 4 (see FIG. 4). The clamp clicks 12*a* and 12*b* of the movable clamp portion 2 are arranged so that their ends oscillate at slightly backward from the rear inner faces 31 of the stationary bits 5.

Moreover, a head cover 29 is fixed at the upper end portions of the adjoining stationary bits 5 and covers the upper side of the end portion of the oscillating arm 3 (see FIG. 2). A through hole 30 is arranged at the center of the upper wall of the head cover 29, and a cylinder 32 which is attached along the vertical axis L at the end portion of the oscillating arm 3 penetrates through the through hole 30.

The cylinder 32 adjusts the height of a blade material guiding roller 33 which holds a blade material so that the width direction of the blade material is kept vertical. The blade material guiding roller 33 having a circumferential V-groove 36 is attached to the front end portion of the oscillating arm 3. The blade material guiding roller 33 fits outside of the edge 34 at the upper marginal end of the blade material 1 and freely rolls touching the both taper faces 35 of the edge 34. (See FIG. 2 and FIG. 5.) The blade material guiding roller 33 is attached to the bottom end of a sliding rod of the cylinder 32 through a pivot member (not shown in the attached drawings) and freely rotates on a horizontal axis.

Figure 5:
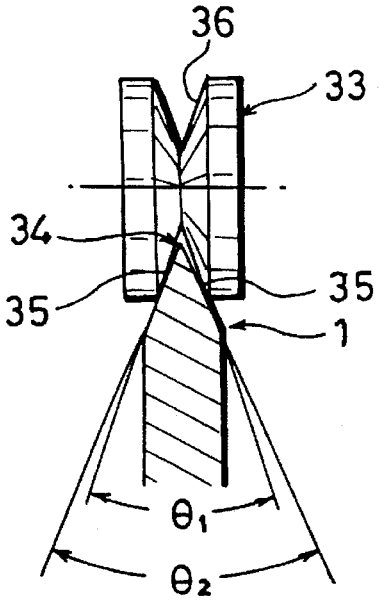
FIG. 5 is an explanatory view of a blade material guiding roller of the apparatus for bending blade material of FIG. 1.

The cylinder 32 thereby ascends and descends the blade material guiding roller 33 to the width (the height) of the blade material 1, and the width direction of the blade material 1 is kept vertical. As shown in FIG. 5, the opening angle $\theta_1$ of the circumferential V-groove 36 of the blade material guiding roller 33 is arranged to be smaller than the edge angle $\theta_2$ of the blade material 1. It is therefore possible to prevent the edge 34 of the blade material 1 to be damaged by touching the bottom of the circumferential V-groove 36. It is desirable to arrange the opening angle $\theta_1$ of the circumferential V-groove 36 of the blade material guiding roller 33 within a range of 30° to 40°, however, this range is not restrictive.

As shown in FIG. 1 and FIG. 3, the oscillation driving mechanism 6 is placed on the backward portion of the oscillating arm 3. This oscillation driving mechanism 6 is provided with a rack 16 which is arc-shaped in a plane of projection and fixed on the base 4, a pinion gear 17 which is placed on the backward portion of the oscillating arm 3 and gears with the rack 16, and a motor $M_1$ driving the pinion gear 17 to rotate. A reducer 18 is applied between the motor $M_1$ and the pinion gear 17. The motor $M_1$, reducer 18, and pinion gear 17 are attached to the oscillating arm 3 through fitting members 25 and 26. The oscillating arm 3 is self-oscillating. The center of the arc of the rack 16 is arranged to coincide with the vertical axis L as the pivotal axis of oscillation of the oscillating arm 3. An encoder is attached to the bottom of the motor $M_1$ in most cases, however, it can be attached to the bottom of the oscillating arm 3.

In FIG. 1, the length $N_1$ from a pivot point P where the oscillating arm 3 is attached to the base 4 and pivots to the movable clamp portion 2 of the oscillating arm 3 and the distance $N_2$ from the pivot point P to a point of application Q where the oscillation driving mechanism 6 applies force on the oscillating arm 3 are arranged so that $N_2/N_1=20$. That is to say, the distance $N_2$ from the pivot point P (the point coinciding with the axis L) where the oscillating arm 3 is connected with the base 4 to the point of application Q where the oscillation driving mechanism 6 applies force on the oscillating arm 3 is arranged to be sufficiently larger than the length $N_1$ from the pivot point P to the movable clamp portion 2 of the oscillating arm 3. It is therefore possible to apply leverage in bending process. Consequently, a small-sized motor of low output can be used as the motor $M_1$. It is preferable to arrange the length $N_1$ and the distance $N_2$ so that $N_2/N_1=20$ as described in the foregoing in view of bending accuracy, however, they can be freely changed within a range of $N_2/N_1=10-N_2/N_1=30$.

A first guide rail 19 which is arc-shaped in a plane of projection is attached on the base 4 and passes under the backward portion of the oscillating arm 3. A plurality of freely rolling guide rollers 20 are attached to the backward portion of the oscillating arm 3, and they freely roll holding and touching the first guide rail 19. As shown in FIG. 3, the first guide rail 19 consists of a member of a T-shaped configuration in the cross section with a tapered front marginal end and a tapered rear marginal end, and the rack 16 is placed along the inner side of the bottom of the first guide rail 19. The first guide rail 19 is fixed on an installation frame 22 placed on the upper face of the base 4 through screw members 27. The freely rolling guide rollers 20 are respectively provided with a V-groove in the circumferential direction, and the front marginal end and rear marginal end of the first guide rail 19 fit into the V-grooves. In the attached drawings, four freely rolling guide rollers 20 are used, and the front marginal end and rear marginal end of the first guide rail 19 respectively touch two freely rolling guide rollers 20.

In order to decrease friction between the first guide rail 19 and the freely rolling guide rollers 20 and smoothen oscillation of the oscillating arm 3, an oil supplying means 48 is attached to the bottom of the oscillating arm 3, and the oil supplying means 48 is provided with an oil tank 47 and an oil applying portion 46 substantially comprising felt touching and freely rubbing the rear marginal end of the first guide rail 19.

Curvature finely regulating mechanisms 21 finely regulating the radius of curvature of the first guide rail 19 are attached to the left and right end portions of the first guide rail 19. The curvature finely regulating mechanisms 21 respectively consist of stationary pieces 23 fixed to the left and right end portions of the installation frame 22 on the base 4 and a plurality of screw members 24 which freely screw forward and backward in a plurality of tapped holes arranged at the stationary pieces 23 with the ends thereof touching the rear face of the first guide rail 19. The radiuses of curvature of the first guide rail 19 and the rack 16 are finely adjusted by loosening the screw members 27 of the rack 16 and screwing the screw members 24 of the curvature finely regulating mechanisms 21 forward and backward. After fine regulation of the radiuses of curvature is completed, the screw members 27 of the curvature finely regulating mechanisms 21 are fastened.

As shown in FIG. 1 and FIG. 2, a second guide rail 38 which is arc-shaped in a plane of projection is placed on the base 4 passes under the backward portion of the oscillating arm 3. A sliding guide member 39 is attached to the forward portion of the oscillating arm 3, and fits in and freely slides on the second guide rail 38. Curvature finely regulating mechanisms 40 finely regulating the radius of curvature of the second guide rail 38 are attached to the both end portions of the second guide rail 38. Likewise the curvature finely regulating mechanisms 21 in the foregoing, the curvature finely regulating mechanisms 40 respectively consist of stationary pieces 23 and a plurality of screw members 24 which freely screw forward and backward in a plurality of tapped holes arranged at the stationary pieces 23 with the ends thereof touching the rear face of the second guide rail 38. Owing to the construction described above, the oscillating arm 3 oscillates accurately on the vertical axis L, and this increases bending accuracy of the blade material 1.

As shown in FIG. 1, the feeding mechanism 7 is provided with a freely rolling ball screw 41 arranged along the oscillating arm 3, a blade material feeding member 42 which fits and screws on the ball screw 41 freely screwing forward and backward and is attached to the oscillating arm 3 freely sliding forward and backward, and a motor $M_2$ which is attached to the front end portion of the oscillating arm 3 and rotates the ball screw 41. A reducer 45 is applied between the ball screw 41 and the motor $M_2$. The blade material feeding member 42 is provided with adjoining chucking click portions 43 holding the rear end portion of the blade material 1 and a sliding support portion 44 having an opening and closing mechanism for freely opening and closing the chucking click portions 43. A guiding rod 59 is placed under the ball screw 41 and freely slides forward and backward holding the sliding support portion 44 (see FIG. 2 and FIG. 3).

The oscillation driving mechanism 6, feeding mechanism 7, and driving mechanism 15 are automatically controlled by a controlling means not shown in the attached drawings so that the blade material 1 is bent to a predetermined configuration.

Figure 6:
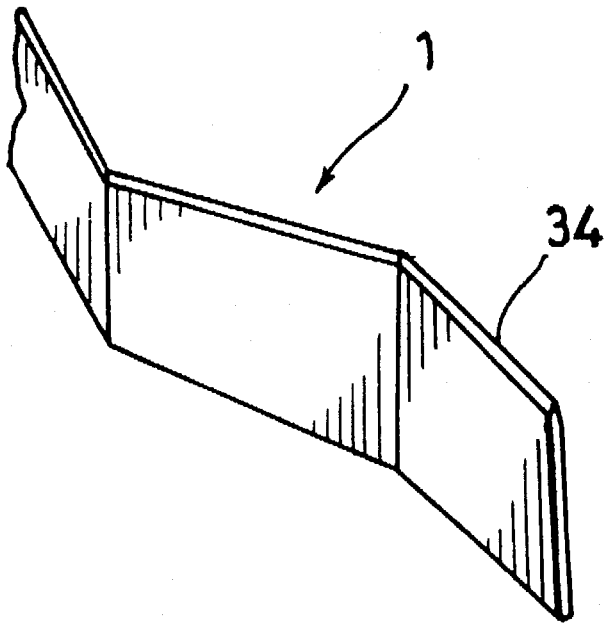
FIG. 6 is a perspective view of a principal portion of a blade material after bending process.

For example, in order to bend the blade material 1 as partly shown in FIG. 6, the blade material 1 is set on the oscillating arm 3 and held between the click portions 43 of the feeding mechanism 7 as shown in FIG. 1.

Figure 9:
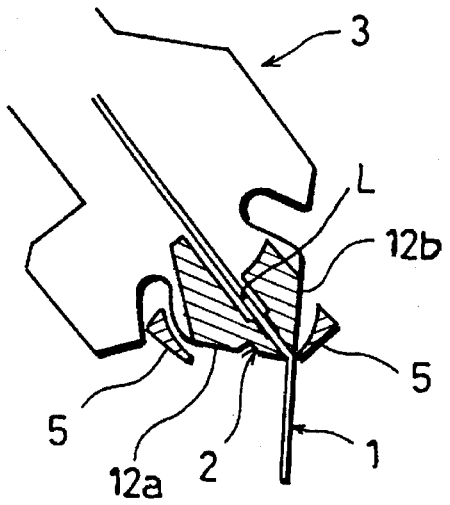
FIG. 9 is an enlarged top plan view of a principal portion of the apparatus for bending blade material of FIG. 1 under operating situation.

When a button for starting bending process is pushed, the clamp clicks 12*a* and 12*b* of the clamp portion 2 open and the feeding mechanism 7 feeds the blade material 1 forward. When the blade material 1 reaches the first bending position, the feeding mechanism 7 stops and the clamp clicks 12*a* and 12*b* shut and firmly fix the blade material 1. Next, the oscillation driving mechanism 6 oscillates the oscillating arm 3 toward the direction of the arrow A in FIG. 7. As shown in an enlarged view in FIG. 9, one of the side faces of the blade material 1 (the right side face in the drawing) touches the inner marginal end of one of the stationary bits 5 (the right side), and the blade material 1 is bent between the inner marginal end of the stationary bit 5 and the ends of the clamp cricks 12*a* and 12*b*.

When the blade material 1 is bent to a predetermined angle, the oscillating arm 3 stops. In other words, the number of rotation of the motor $M_1$ of the oscillation driving mechanism 6 is accurately controlled, and the motor $M_1$ of the oscillation driving mechanism 6 stops when the oscillating arm 3 oscillates from the central position shown in FIG. 1 to a predetermined angle inputted beforehand.

After bending the blade material 1 as described above, the motor $M_1$ of the oscillation driving mechanism 6 rotates to the reverse direction, and the oscillating arm 3 oscillates to the reverse direction. The driving mechanism 15 opens the clamp clicks 12*a* and 12*b* of the clamp portion 2, and the feeding mechanism 7 feeds the blade material 1 forward. When the blade material i reaches the next bending position, the feeding mechanism 7 stops and the driving mechanism 15 shuts the clamp clicks 12*a* and 12*b* of the clamp portion 2.

Figure 10:
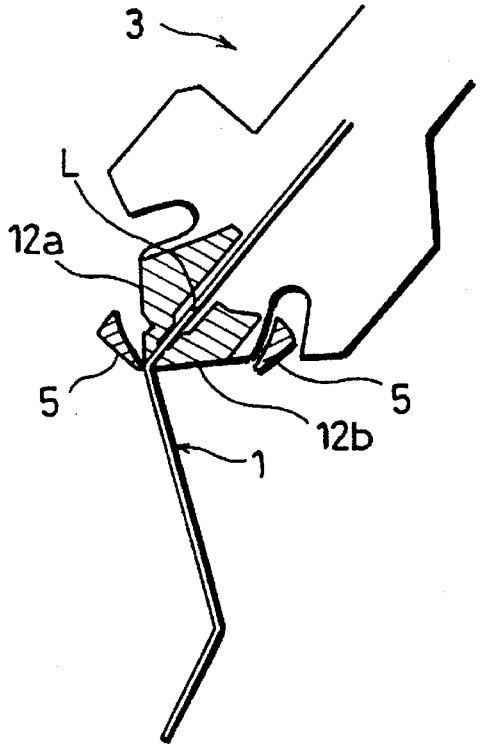
FIG. 10 is an enlarged top plan view of a principal portion of the apparatus for bending blade material of FIG. 1 under operating situation.

Subsequently, the oscillating arm 3 oscillates toward the direction of the arrow B in FIG. 8. As shown in an enlarged view in FIG. 10, the other side face of the blade material 1 (the left side face in the drawing) touches the inner marginal end of the other stationary bit 5 (the left side), and between the inner marginal end of the stationary bit 5 and the ends of the clamp clicks 12*a*, 12*b*, the blade material 1 is bent opposite from the direction in FIG. 9. When the blade material is bent to a predetermined angle, the oscillating arm 3 stops.

Figure 7:
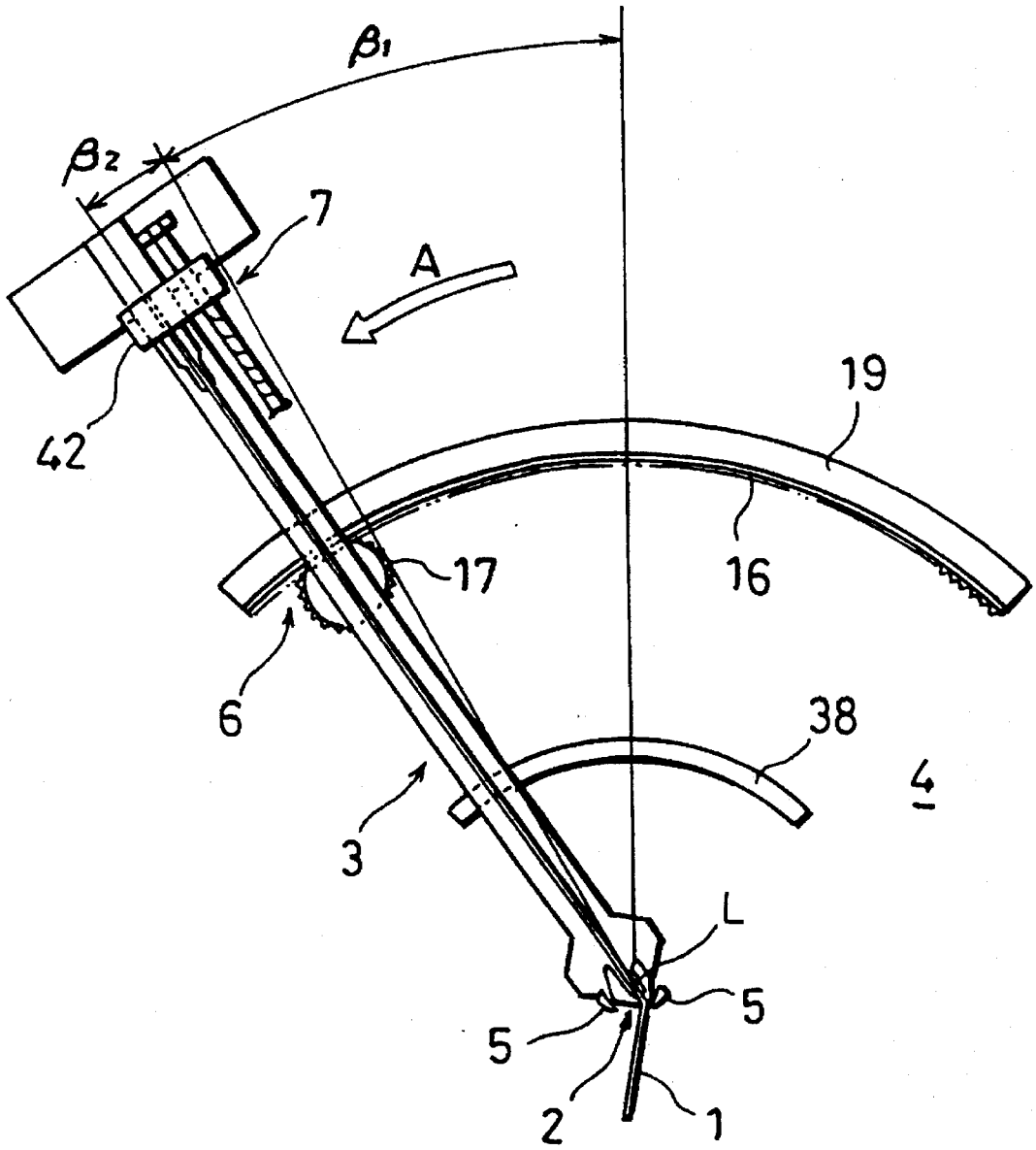
FIG. 7 is an explanatory view of working of the apparatus for bending blade material of FIG. 1 under operating situation.
Figure 8:
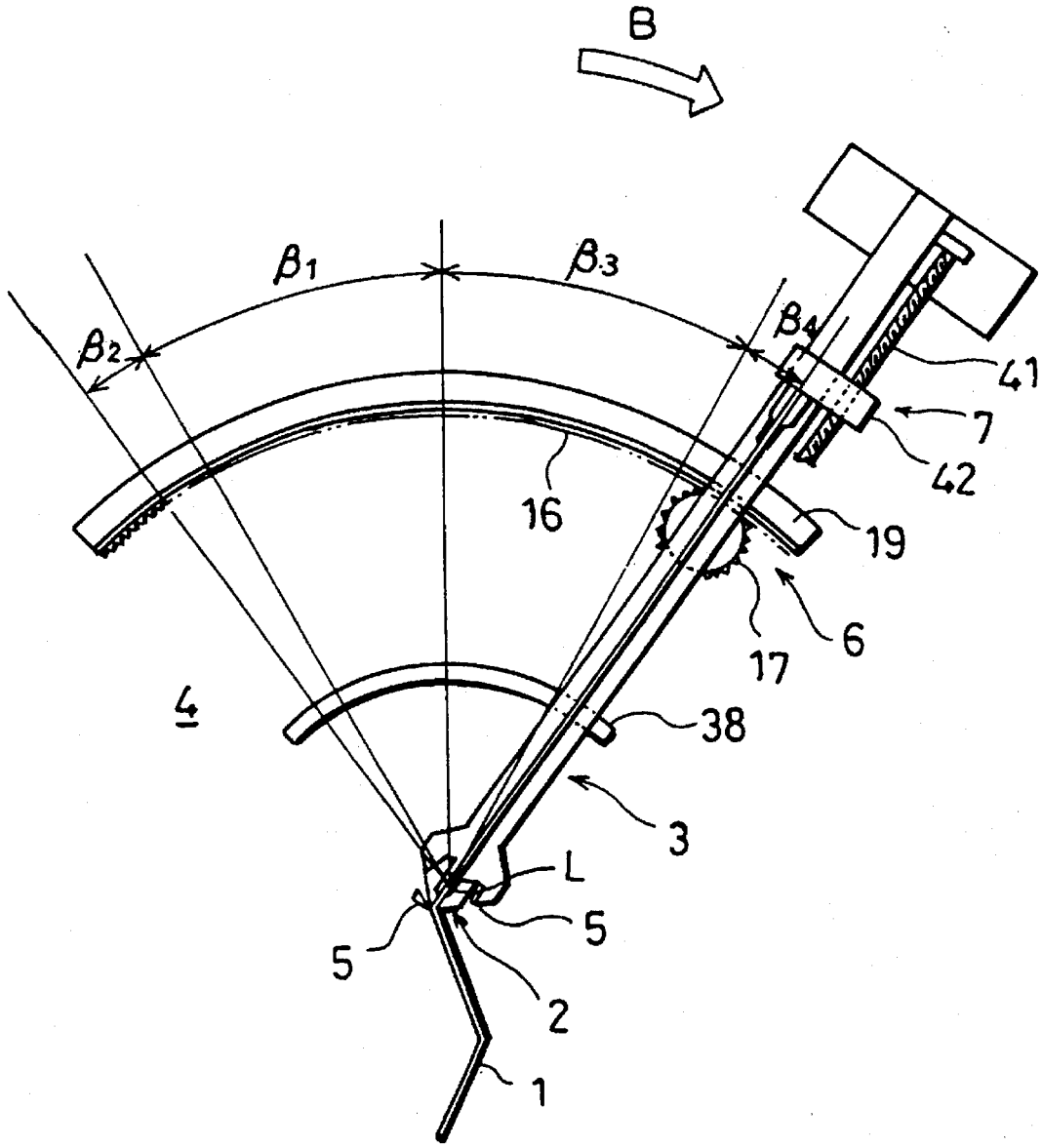
FIG. 8 is an explanatory view of working of the apparatus for bending blade material of FIG. 1 under operating situation.

In FIG. 7 and FIG. 8, when the oscillating arm 3 oscillates between the angles $\beta_1$ and $\beta_3$ where the blade material 1 does not touch any of the stationary bits 5, the motor of the oscillation driving mechanism 6 is accelerated and oscillates the oscillating arm 3 quickly. When the oscillating arm 3 oscillates between the angles $\beta_2$ and $\beta_4$ where the blade material 1 touches one of the stationary bits 5, the oscillating arm 3 is oscillated slowly and accurately.

The angle of oscillation of the oscillating arm 3 is controlled through absolute programming. That is to say, assuming that the situation of the oscillating arm 3 at the central position as shown in FIG. 1 is the origin, the oscillating arm 3 oscillates only in a direction to an angle arranged beforehand in a bending process. In the similar manner, assuming that the central position is the origin, the oscillating arm 3 is controlled to oscillate in a direction to an angle arranged beforehand in a further bending process. This prevents accumulation of errors in the angles for which the oscillating arm 3 oscillates, and the blade material 1 is bent accurately to the predetermined angles.

The distance $N_2$ from the pivot point P where the oscillating arm 3 is connected to the base 4 to the point of application Q where the oscillation driving mechanism 6 applies force is arranged to be sufficiently larger than the length $N_1$ from the pivot point P to the movable clamp portion 2, therefore backlash between the rack 16 of the oscillation driving mechanism 6 and the pinion gear 17 is eliminated at the movable clamp portion 2 placed at the front end of the oscillating arm 3. This prevents decrease in bending accuracy caused by backlash, and the blade material 1 is bent with higher accuracy.

Moreover, the motor $M_1$ of the oscillation driving mechanism 6 is small and the motor $M_2$ of the feeding mechanism 7 is attached to the front end portion of the oscillating arm 3, therefore the moment of inertia of the overall oscillating arm 3 is small. Subsequently, it is possible to stop the oscillating arm 3 at an accurate angle and increase accuracy in bending the blade material 1.

The width of horizontal deflection of the front end portion of the blade material 1 becomes relatively small because the blade material 1 is bent toward the opposite side of the moving direction (oscillating direction) of the movable clamp portion 2. Therefore, the front end portion of the blade material 1 rarely touches the workers, and this increases safety in bending operation.

Figure 11:
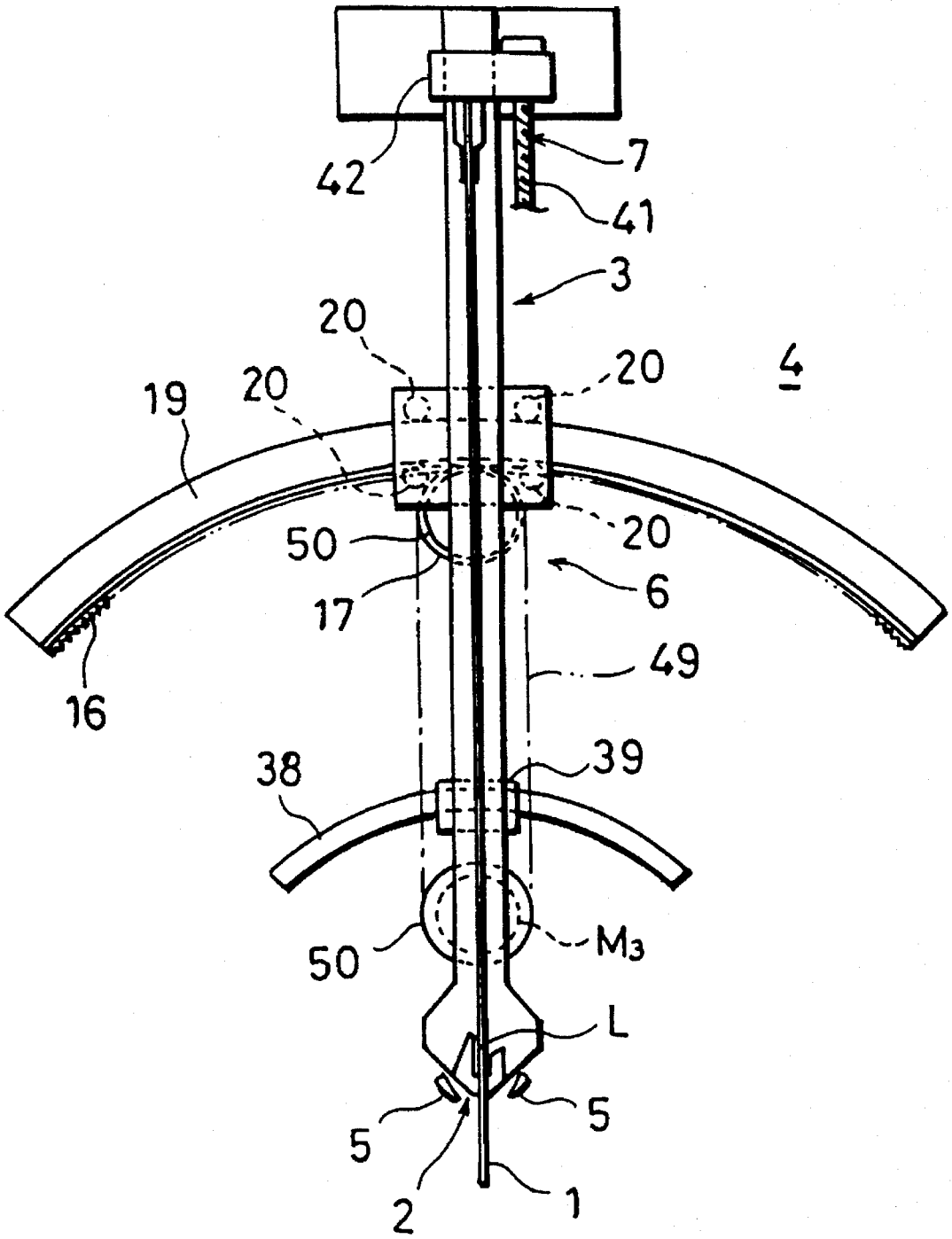
FIG. 11 is a schematic top plan view of a second embodiment of an apparatus for bending blade material according to the present invention.

Next, FIG. 11 shows a second embodiment of the present invention. In this apparatus for bending blade material, an oscillation driving mechanism 6 is provided with a rack 16 which is arc-shaped in a plane of projection and fixed on a base 4. The oscillation driving mechanism 6 is also provided with a pinion gear 17 which is placed on the backward portion of an oscillating arm 3 and gears with the rack 16, and a motor $M_3$ driving the pinion gear 17 to rotate through an endless flex power transmission substance 49 such as a belt or a chain and rotators 50 such as pulleys or gears between which the transmission substance 49 is suspended. The motor $M_3$ is placed under the oscillating arm 3 between the center and the front end portion thereof. The other portion of the construction of this apparatus is the same with that of FIG. 1.

Owing to this construction, moment of inertia of the overall oscillating arm 3 is small. Therefore, it is possible to stop the oscillating arm 3 at an accurate angle and increase accuracy in bending a blade material 1.

Figure 12:
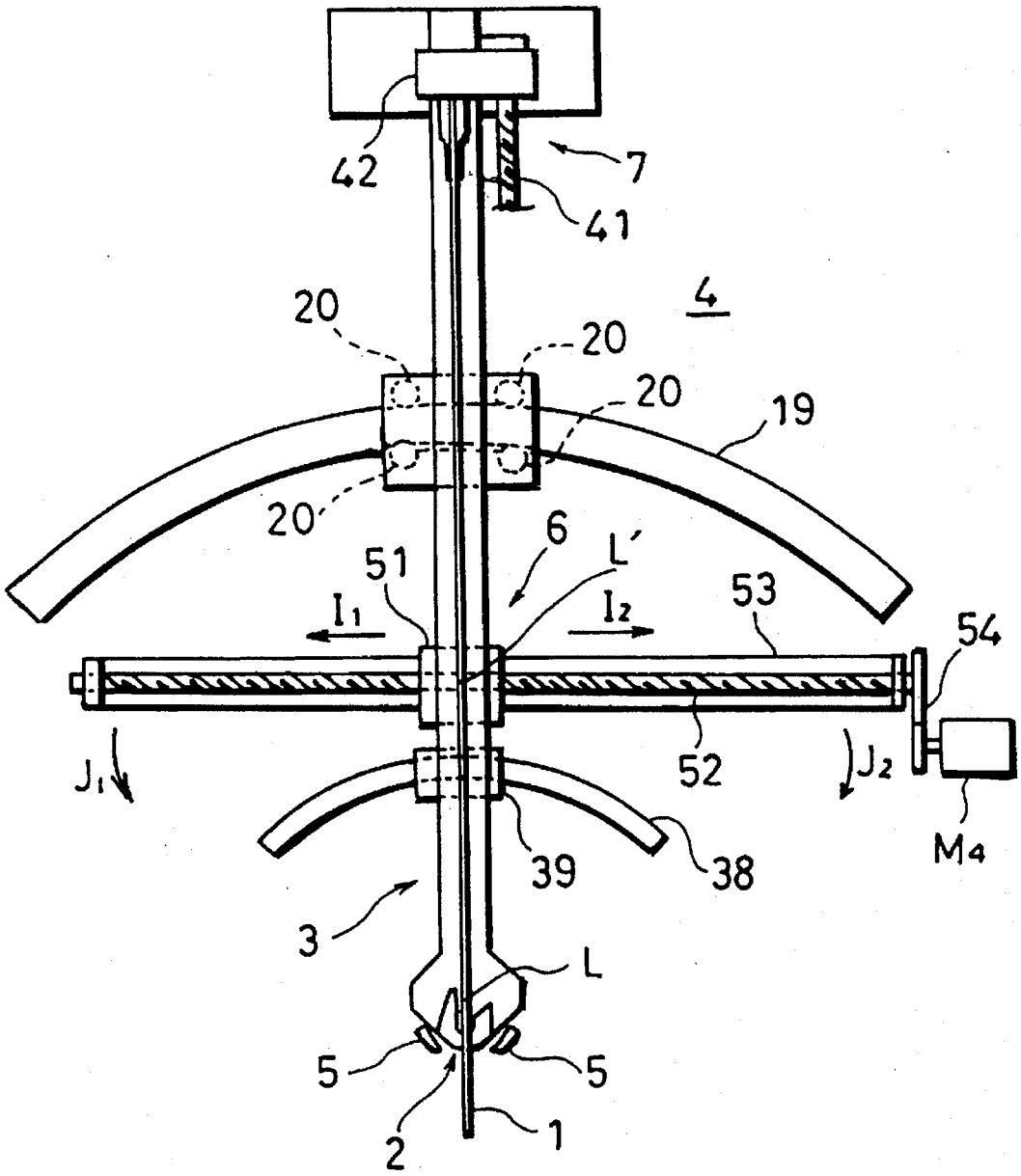
FIG. 12 is a schematic top plan view of a third embodiment of an apparatus for bending blade material according to the present invention.

FIG. 12 shows a third embodiment of the present invention, wherein an oscillation driving mechanism 6 is provided with a nut member 51 which is attached to the backward portion of an oscillating arm 3 and freely oscillates on a vertical axis L'. The oscillation driving mechanism 6 is also provided with a ball screw 52 which screws into the nut member 51, a pivot frame 53 which supports the ball screw 52 so that the ball screw 52 freely rotates and is attached to a base 4 and freely rotates on the vertical axis L', and a motor $M_4$ that rotates the ball screw 52.

A reduction mechanism 54 (for example, a gear) is applied between the motor $M_4$ and the ball screw 52. This apparatus is provided with neither a rack which is arc-shaped in a plane of projection nor a pinion gear that gears with it, and the other portion of the construction is the same with that of FIG. 1.

When the motor $M_4$ rotates, the ball screw 52 rotates, and the nut member 51 moves to left or right. If the nut member 51 moves to the direction of the arrow $I_1$ (toward left in FIG. 12) in the drawing, the oscillating arm 3 oscillates toward the same direction and the nut member 51, ball screw 52, and pivot frame 53 oscillate toward the direction of the arrow $J_1$. On the contrary, if the nut member 51 moves to the direction of the arrow $I_2$ (toward right in the drawing), the oscillating arm 3 oscillates toward the same direction and the nut member 51, ball screw 52, and pivot frame 53 oscillate toward the direction of the arrow $J_2$.

Subsequently, the oscillating arm 3 oscillates smoothly. Moreover, the oscillating arm 3 is not provided with a motor $M_4$ that oscillates the oscillating arm 3 and moment of inertia of the oscillating arm 3 is small, therefore it is possible to stop the oscillating arm 3 at an accurate angle and increase bending accuracy.

Figure 13:
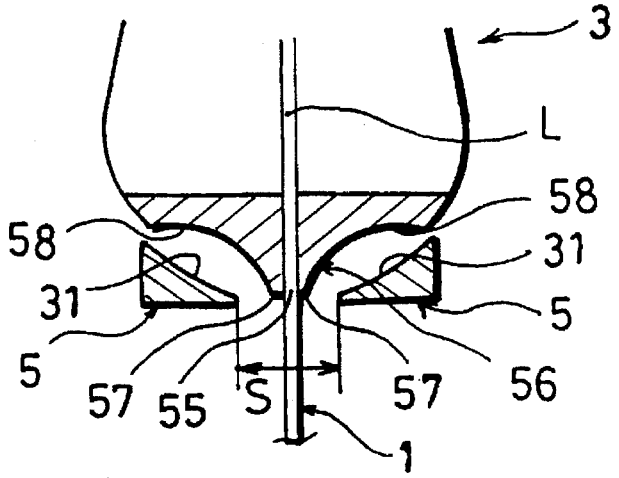
FIG. 13 is a schematic top plan view of a principal portion of a fourth embodiment of an apparatus for bending blade material according to the present invention.

FIG. 13 shows a principal portion of a fourth embodiment of the present invention, and this apparatus is provided with an oscillating arm 3 having a movable mouth portion 56 at the front end portion thereof and a pair of stationary bits 5 arranged at a predetermined distance S between each other on a base 4 near an end of the movable mouth portion 56 of the oscillating arm 3. A slightly backward portion from the movable mouth portion 56 of the oscillating arm 3 is connected with the base 4 and the oscillating arm 3 freely pivots on a vertical axis L. The movable mouth portion 56 is provided with a clearance 55 through which a blade material 1 is freely fed.

The rear inner faces 31 of the stationary bits 5 are arc-shaped in a plane of projection. Recessed portions 58 are formed on the front faces of the movable mouth portion 56 corresponding to the rear inner faces 31 of the stationary bits 5 (at the left and right of clearance forward end portions 57 for feeding blade material).

This apparatus is also provided with an oscillation driving mechanism 6 (not shown in the drawing) which oscillates the oscillating arm 3 toward left and right in order to bend the blade material 1 between the stationary bits 5 and the movable mouth portion 56, and a feeding mechanism 7 (not shown in the drawing) feeding the blade material 1 forward along the oscillating arm 3. The oscillation driving mechanism 6 and the feeding mechanism 7 have the same construction as shown in FIG. 1.

Figure 14:
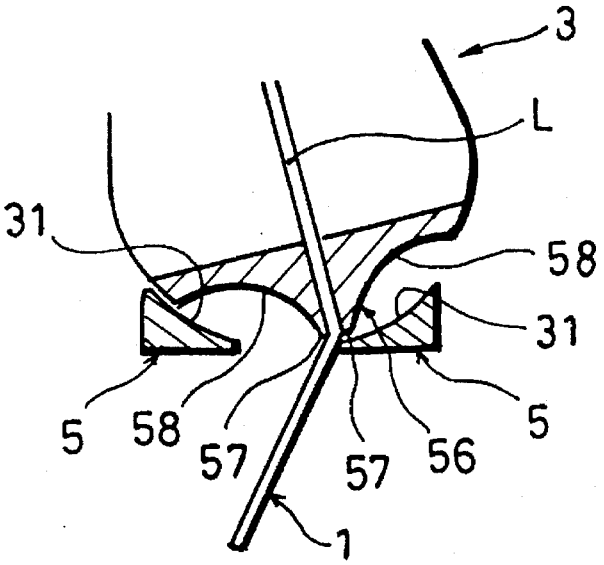
FIG. 14 is a schematic top plan view of a principal portion of the fourth embodiment of the apparatus for bending blade material of FIG. 13 under operating situation.

As shown in FIG. 14, the oscillating arm 3 is oscillated, and the blade material 1 is bent between the clearance forward end portions 57 of the movable mouth portion 56 and the inner marginal end of one of the stationary bits 5. Owing to the recessed portions 58, it is possible to prevent that a part of the blade material 1 is caught between the front face of the movable mouth portion 56 and the rear inner face 31 of one of the stationary bits 5. This is particularly effective when the blade material 1 is thin. It is therefore possible to prevent damaging the blade material 1, movable mouth portion 56, and stationary bits 5.

Figure 15:
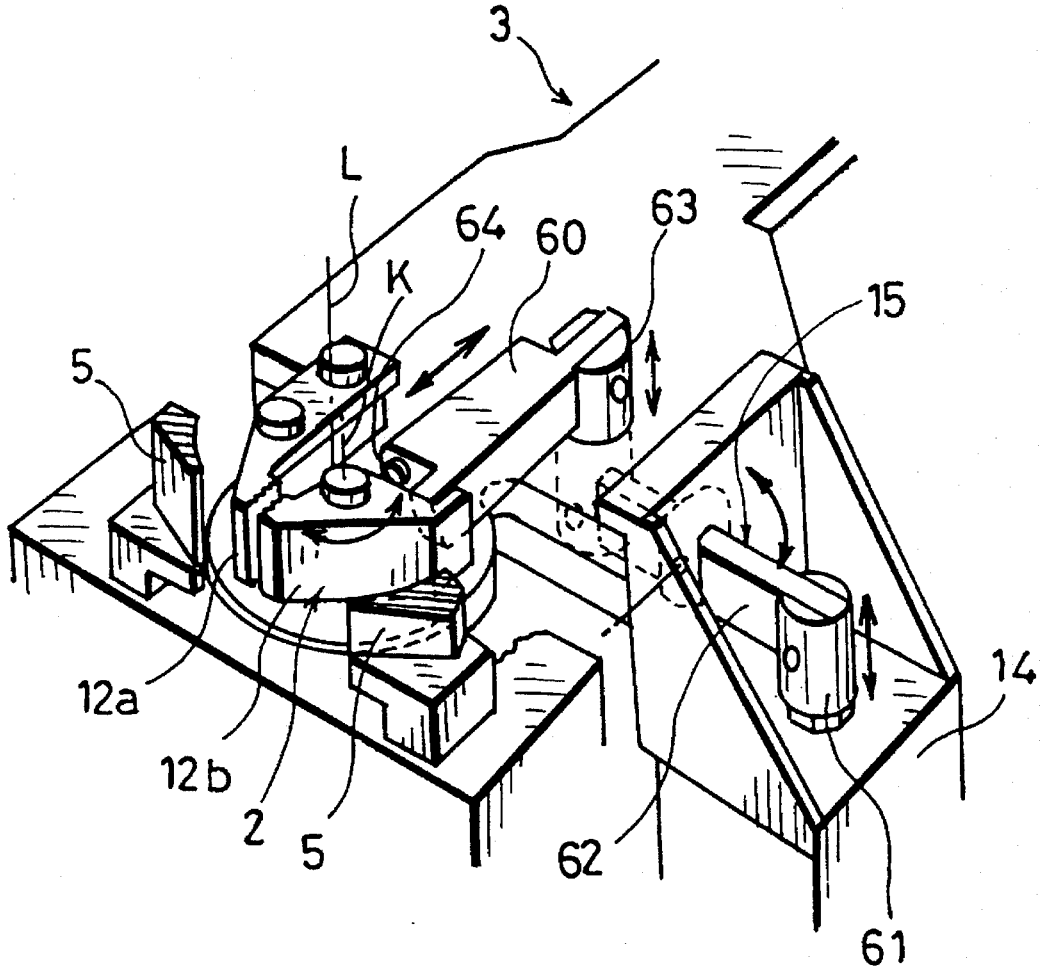
FIG. 15 is an enlarged perspective view of a principal portion of a fifth embodiment of an apparatus for bending blade material according to the present invention.

Next, FIG. 15 shows a fifth embodiment of the present invention. In this apparatus, a clamp click **12*a* of a movable clamp portion 2 is fixed at an end of an oscillating arm 3, and another clamp click 12*b* of the movable clamp click portion 2 is connected to the end of the oscillating arm 3** and freely oscillates on a vertical axis K.

A driving mechanism 15 is provided with a cylinder 14 attached to a side of the front end portion of the oscillating arm 3, an oscillating piece 62 which pivots with the outer end portion thereof connected to a cylinder rod 61 of the cylinder 14, and an ascent and descent member 63 which is inserted through a hole arranged at the oscillating arm 3 and freely moves up and down. The driving mechanism 15 is also provided with a toggle arm 60 which front end portion touches the outer portion of the rear face of the clamp click **12*b* and the upper face of the oscillating arm 3. An elastic member 64 is placed between the inner portion of the rear face of the clamp click 12*b* and the front end portion of the toggle arm 60, and the elastic member 64 stimulates the clamp click 12*b*** to bounce and oscillate toward the opening direction.

An oscillating piece 62 is attached to the front end portion of the oscillating arm 3, and the left and right end portions of the oscillating piece 62 freely oscillates vertically with a horizontal axis in the front and rear direction as the center of oscillation. The ascent and descent member 63 is connected to the inner end portion of the oscillating piece 62 and pivots on the lower end portion thereof. The toggle arm 60 is connected to the upper end portion of the ascent and descent member 63 and pivots on the rear end portion thereof.

When the cylinder rod 61 of the cylinder 14 ascends, the outer end of the oscillating piece 62 oscillates upward while the inner end of the oscillating piece 62 oscillates downward and the ascent and descent member 63 descends, and the rear end of the toggle arm 60 descends. Along with the descent, the front end of the toggle arm 60 moves forward, therefore the outer portion of the rear face of the clamp click **12*b* oscillates forward and the front end portion of the clamp click 12*b* approaches the clamp click 12*a*, and the clamp portion 2 closes. The movable clamp portion 2** is thereby closed tightly and holds and fixes the blade material.

When the cylinder rod 61 of the cylinder 14 descends, the outer end of the oscillating piece 62 oscillates downward while the inner end of the oscillating piece 62 oscillates upward and the ascent and descent member 63 ascends, and the rear end of the toggle arm 60 ascends. Along with the ascent, the front end of the toggle arm 60 moves backward, therefore the front end portion of the clamp click **12*b* oscillates away from the clamp click 12*a* due to the elasticity of the elastic member 64, and the clamp portion 2** opens.

The oscillation driving mechanism 6 and the feeding mechanism 7 have the same construction as shown in FIG. 1. Instead of the construction shown in FIG. 1, the construction of the oscillation driving mechanism 6 and the feeding mechanism 7 can be the same with the construction as shown in FIG. 11 or FIG. 12.

It is desirable to use a toggle mechanism as the driving mechanism 15 in order to increase clamp force due to the clamp clicks **12*a*, 12*b*, and prevent the blade material 1** to slip out of the position in bending process.

Figure 16:
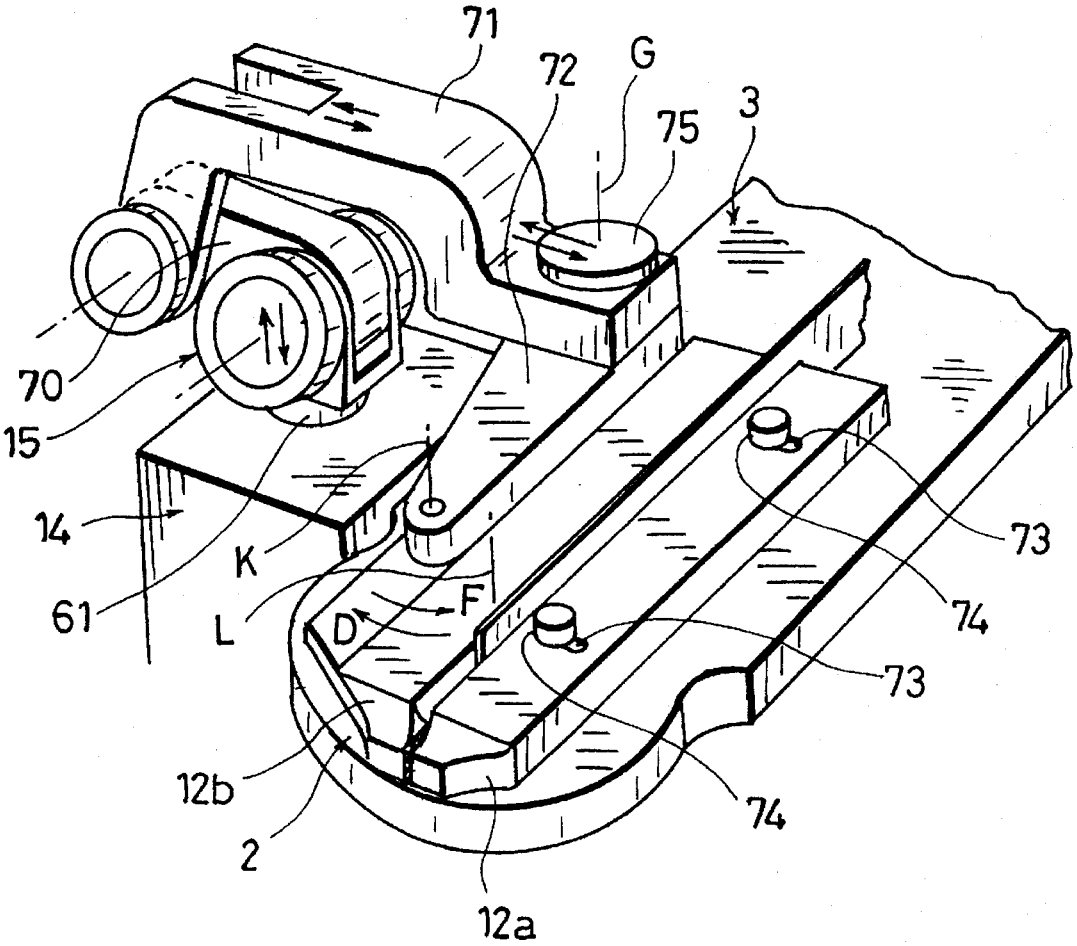
FIG. 16 is an enlarged perspective view of a principal portion of a sixth embodiment of an apparatus for bending blade material according to the present invention.
Figure 17:
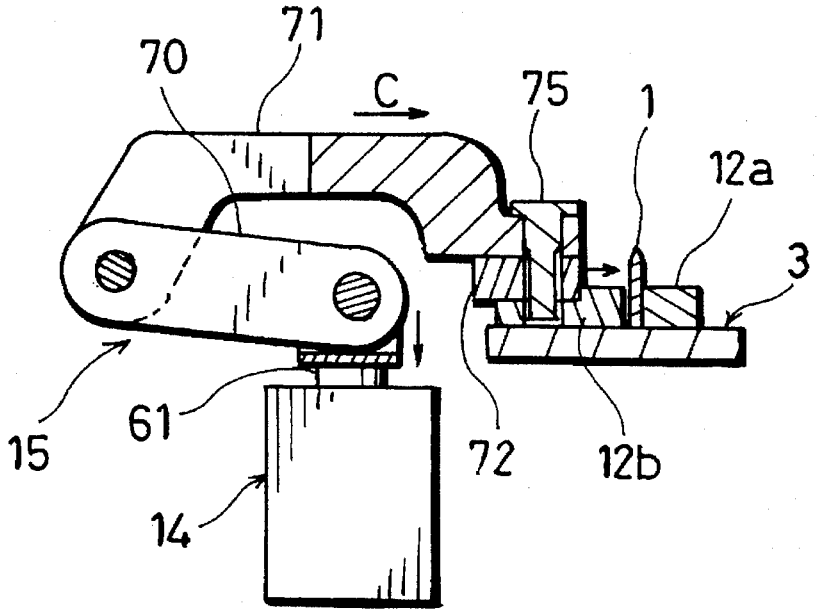
FIG. 17 is a sectional view of a principal portion of an opened clamp click of the sixth embodiment of the apparatus for bending blade material.
Figure 18:
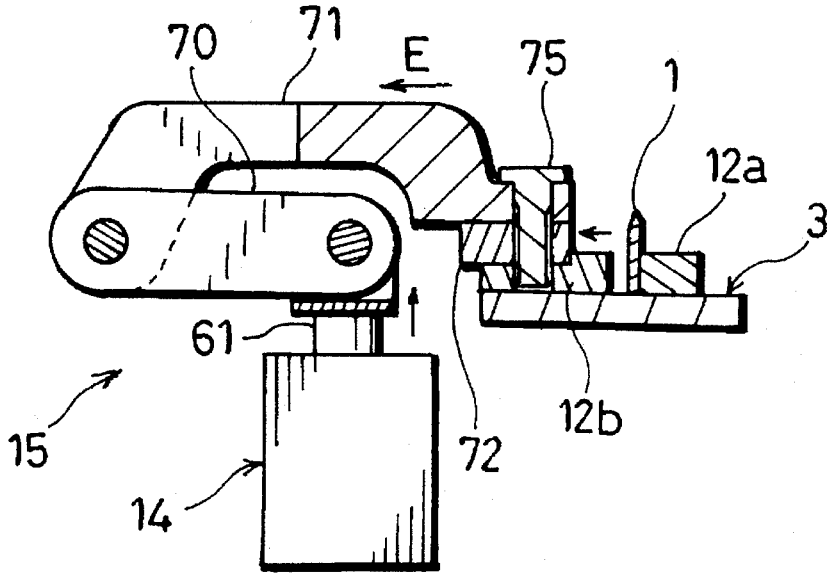
FIG. 18 is a sectional view of a principal portion of a closed clamp click of the sixth embodiment of the apparatus for bending blade material.

Next, FIG. 16, FIG. 17, and FIG. 18 show a sixth embodiment. A driving mechanism 15 is provided with a cylinder 14 attached to a side of the front end portion of an oscillating arm 3, an oscillating piece 70 which pivots with the inner end portion connected to a cylinder rod 61 of the cylinder 14, and a horizontally movable arm 71 which is connected to the outer end portion of the oscillating piece 70 and pivots on the outer end portion thereof. The driving mechanism 15 also possesses a stiffner 72 which is attached to a clamp click 12*b* that freely oscillates on a vertical axis K. The horizontally movable arm 71 is connected to the base end portion of the stiffner 72 through a pivot tool 75 and pivots on the inner end portion thereof.

Another clamp click 12*a* facing the clamp click 12*b* is provided with long holes 73 in the left and right direction. The clamp click 12*a* is fixed on the oscillating arm 3 through screw members 74 which are inserted through the long holes 73.

The oscillating piece 70 is, as shown in FIG. 17, connected to the cylinder rod 61 and the horizontally movable arm 71 so that the outer end portion of the oscillating piece 70 is positioned higher than the inner end portion of the oscillating piece 70 when the end portions of the clamp clicks 12*a*, 12*b* are relatively opened. As shown in FIG. 16, the length from the vertical axis K to a pivotal axis G of the clamp click 12*b* and the horizontally movable arm 71 is arranged to be larger than the length from the vertical axis K to the end of the clamp click 12*b*. Clamp force of the movable clamp portion 2 is thereby increased by applying leverage, and the blade material 1 does not relatively slip out of the position against the movable clamp portion 2.

The clamp click 12*a* fixed on the oscillating arm 3 and the clamp click 12*b* freely oscillated on the vertical axis K are arranged reversely in the left and right direction from the position shown in FIG. 1, FIG. 2, FIG. 4, FIG. 9, FIG. 10, and FIG. 15. The other portion of the construction of this apparatus is the same with the construction shown in FIGS. 1–10.

When the cylinder rod 61 ascends as shown in FIG. 18 from the situation of FIG. 17 with the clamp clicks 12*a*, 12*b* opened, the oscillating piece 70 becomes roughly horizontal, and the outer end portion of the oscillating piece 70 pushes the outer end portion of the horizontally movable arm 71 toward the direction of the arrow E and the horizontally movable arm 71 moves toward the same direction. In this situation, the cylinder rod 61, oscillating piece 70, and horizontally movable arm 71 form a toggle mechanism, and the base end portion of the clamp click 12*b* oscillates away from a side face of the blade material 1. Consequently, the end of the clamp click 12*b* oscillates toward the direction of the arrow F in FIG. 16, and the end of the clamp click 12*b* presses the side face of the blade material 1, and the clamp clicks 12*a*, 12*b* close.

Owing to the toggle mechanism formed by the cylinder rod 61, oscillating piece 70, and horizontally movable arm 71, enormous clamp force is produced, and it is possible to fix the blade material firmly.

When the cylinder rod 61 descends as shown in FIG. 17 from the situation of FIG. 18 with the clamp clicks 12*a*, 12*b* closed, the inner end portion of the oscillating piece 70 descends and the horizontally movable arm 71 moves inwardly as shown with the arrow C. Consequently, the end of the clamp click 12*b* oscillates toward the direction shown with the arrow D in FIG. 16, and the end of the clamp click 12*b* moves away from the side face of the blade material 1, and the ends of the clamp clicks 12*a*, 12*b* open.

The clamp click 12*a* can be slid toward the left and right direction by loosening the screw members 74. It is therefore possible to adjust the position of the clamp click 12*a* so that the center of the blade material 1 in the longitudinal direction coincides with a vertical axis L, i.e. the central axis of oscillation of the oscillating arm 3. After adjusting the position of the clamp click 12*a*, the screw members 74 are fastened.

The construction of this embodiment excluding the driving mechanism 15 and the clamp clicks 12*a*, 12*b* can be the same with the construction shown in FIG. 11. It can be also arranged to be the same with the construction shown in FIG. 12.

In FIG. 1, FIG. 2, FIG. 7, FIG. 8, FIG. 11, and FIG. 12, the second guide rail 38, sliding guide member 39, and curvature finely regulating mechanisms 40 can be freely omitted (not shown in the drawings).

According to the present invention, a strip-shaped blade material is bent automatically and accurately. Moreover, the construction is simple and the apparatus is easily produced. A blade material 1 is bent toward the direction opposite from the oscillation direction of the movable clamp portion 2 and the oscillation width toward left and right of the front end portion of the blade material 1 is decreased, and this prevents the workers from being injured. Besides, owing to the clamp portion 2, it is possible to bend a blade material 1 regardless of the thickness.

The distance $N_2$ from the pivot point where the oscillating arm is pivoted on the base to the point of application where the oscillation driving mechanism applies force on the oscillation arm is sufficiently larger than the length $N_1$ from the pivot point to the movable clamp portion of the oscillating arm, therefore, the blade material is bent with accuracy even if the driving force of the oscillation driving mechanism 6 is small, and it is possible to prevent decrease in the bending accuracy caused by backlash.

The feeding mechanism 7 is provided with the ball screw 41, blade material feeding member 42, and motor $M_2$, and the blade material is fed automatically with accuracy. Therefore, the bending process is completely automatized.

The blade material guiding roller 33 is provided at the end portion of the oscillating arm 3, and the opening angle $\theta_1$ of the circumferential V-groove 36 of the blade material guiding roller 33 is arranged to be smaller than the edge angle $\theta_2$ of the blade material 1, therefore the edge 34 of the blade material 1 is not damaged at the end portion of the oscillating arm 3, and the blade material 1 is kept so that the width direction of the blade material 1 is vertical. Bending accuracy is thereby increased.

A plurality of freely rolling guide rollers 20 are attached to the backward portion of the oscillating arm 3 and they freely pivot touching the first guide rail 19, therefore the strip-shaped blade material is automatically bent to an angle with extreme accuracy.

The curvature finely regulating mechanisms 21 finely adjusting the radius of curvature of the first guide rail 19 are attached to the both end portions of the first guide rail 19, therefore the oscillating arm 3 oscillates smoothly and accuracy in bending the blade material is increased.

The apparatus of the present invention is constructed so that the oscillation angle of the oscillating arm 3 is controlled through absolute programming, therefore the oscillation angle of the oscillating arm 3 is controlled with high accuracy, and bending accuracy of the blade material is further increased.

If the apparatus is arranged so that the oscillation driving mechanism 6 is provided with the rack 16, pinion gear 17, and motor $M_1$, a small-sized motor can be used as the motor $M_1$ of the oscillation driving mechanism 6. Moreover, the oscillating arm 3 is oscillated smoothly.

If the apparatus is arranged so that the oscillation driving mechanism 6 is provided with the motor $M_3$ which rotates the pinion gear 17 through the endless flex power transmission substance 49 and rotators 50, moment of inertia of the oscillating arm 3 decreases, therefore it is possible to stop the oscillating arm 3 accurately at an angle and increase bending accuracy.

If the apparatus is arranged so that oscillation driving mechanism 6 is provided with the nut member 51, ball screw 52, pivot frame 53, and motor $M_4$ rotating the ball screw 52, moment of inertia of the oscillating arm 3 decreases, therefore it is possible to stop the oscillating arm 3 accurately at an angle, and this improves bending accuracy.

If the apparatus is arranged so that the oscillating arm 3 possesses the movable mouth portion 56 at the front end portion thereof and freely rotates on the vertical axis L with the backward portion of the oscillating arm attached to the base 4, and the pair of stationary bits 5 are adjacently placed on the base 4 near the end of the movable mouth portion 56 of the oscillating arm 3 keeping a predetermined mutual space S, a strip-shaped blade material is automatically bent with accuracy. Besides, the construction becomes simple and the apparatus is manufactured easily.

If the apparatus is arranged so that the rear inner faces 31 of the stationary bits 5 are arc-shaped in a plane of projection and the front faces of the movable mouth portion 56 corresponding to the rear inner faces 31 of the stationary bits 5 are provided with recessed portions 58 at the left and right of the clearance forward end portions 57 where the blade material is fed, it is possible to avoid that a part of the blade material 1 is caught between the front face of the movable mouth portion 56 and the rear inner face 31 of one of the stationary bits 5. Consequently, it is possible to prevent the blade material 1 to be damaged. Moreover, the movable mouth portion 56 and the stationary bits 5 are prevented from being damaged, and durability of the apparatus increases.

While preferred embodiments of the present invention have been described in this specification, it is to be understood that the invention is illustrative and not restrictive, because various changes are possible within the spirit and indispensable features.

I claim:

1. An apparatus for bending blade material comprising:

an oscillating arm having a movable clamp portion for freely fixing and releasing a strip-shaped blade material at a front end portion thereof and rotating freely on a vertical axis with a portion thereof slightly backward from said clamp portion connected to a base:

a pair of stationary bits placed on said base near an end of said movable clamp portion of said oscillating arm and adjoining at a predetermined distance;

an oscillation driving mechanism attached to said backward portion of said oscillating arm and oscillating said oscillating arm horizontally in order to bend said blade material between said stationary bits and said movable clamp portion; and a feeding mechanism sending said blade material forward along said oscillating arm, wherein a length $N_1$ from a pivot point where said oscillating arm is attached to said base and pivots to said movable clamp portion of said oscillating arm and a distance $N_2$ from said pivot point to a point of application where said oscillating driving mechanism applies force on said oscillating arm are arranged so that $N_2/N_1=10$–$N_2/N_1=30$.

2. The apparatus for bending blade material as set forth in claim 1, wherein said oscillation driving mechanism comprises:

a rack which is arc-shaped in a plane of projection and fixed on said base;

a pinion gear which is attached to said backward portion of said oscillating arm and gears with said rack; and a motor that rotates said pinion gear.

3. The apparatus for bending blade material as set forth in claim 1, wherein said feeding mechanism comprises:

a ball screw which is arranged along with said oscillating arm and rotates freely;

a blade material feeding member which fits on said ball screw and freely screws forward and backward and is attached to said oscillating arm and freely slides forward and backward; and a motor which is attached to said front end portion of said oscillating arm and rotates said ball screw.

4. The apparatus for bending blade material as set forth in claim 1, wherein a blade material guiding roller having a circumferential V-groove and fitting outside of an edge at an upper marginal end of said blade material and freely rolling and touching taper faces of said edge is attached to an end of said oscillating arm, and an opening angle of said circumferential V-groove of said blade material guiding roller is arranged to be smaller than an edge angle of said blade material.

5. The apparatus for bending blade material as set forth in claim 1, wherein said oscillation driving mechanism comprises:

a rack which is arc-shaped in a plane of projection and fixed on said base;

a pinion gear which is attached to said backward portion of said oscillating arm and gears with said rack; and a motor that rotates said pinion gear through an endless flex power transmission substance and rotators between which said transmission substance is suspended, wherein said motor is attached within a region between a center of said front end portion of said oscillating arm.

6. The apparatus for bending blade material as set forth in claim 1, wherein said oscillation driving mechanism comprises:

a nut member which is attached to said backward portion of said oscillating arm and freely rotates on said vertical axis;

a ball screw which screws into said nut member;

a pivot frame which supports said freely rolling ball screw and is placed on said base so that said pivot frame freely oscillates on said vertical axis; and a motor which rotates said ball screw.

7. The apparatus for bending blade material as set forth in claim 1, wherein a first guide rail which is arc-shaped in a plane of projection is placed on said base and passes under said backward portion of said oscillating arm, and a plurality of freely rolling guide rollers attached to said backward portion of said oscillating arm hold said first guide rail and freely roll touching said first guide rail.

8. The apparatus for bending blade material set forth in claim 7, wherein curvature finely regulating mechanisms which finely adjust a radius of curvature of said first guide rail are attached to first and second end portions of said first guide rail.

9. The apparatus for bending blade material as set forth in claim 7, wherein an oscillation angle of said oscillating arm is under control of absolute programming.

10. An apparatus for bending blade material comprising:

an oscillating arm having a movable mouth portion with a clearance through which a strip-shaped blade material is freely sent at a front end portion thereof and being attached to a base and rotating freely on a vertical axis that passes through a portion thereof slightly backward from said movable mouth portion;

a pair of stationary bits placed on said base near an end of said movable mouth portion of said oscillating arm and adjoining at a predetermined mutual space;

an oscillation driving mechanism attached to said backward portion of said oscillating arm and oscillating said oscillating arm horizontally in order to bend said blade material between said stationary bits and said movable mouth portion; and a feeding mechanism sending said blade material forward along said oscillating arm, wherein a length $N_1$ from a pivot point where said oscillating arm is attached to said base and pivots to said movable clamp portion of said oscillating arm and a distance $N_2$ from said pivot point to a point of application where said oscillating driving mechanism applies force on said oscillating arm are arranged so that $N_2/N_1=10-N_2/N_1=30$.

11. The apparatus for bending blade material as set forth in claim 10, wherein rear inner faces of said stationary bits are arc-shaped in a plane of projection and front faces of said movable mouth portion corresponding to said rear inner faces of said stationary bits are provided with recessed portions at a left and right of clearance forward end portions where said blade material is fed.

12. An apparatus for bending blade material comprising:

an oscillating arm having a movable clamp portion for freely fixing and releasing a strip-shaped blade material at a front end portion thereof and rotating freely on a vertical axis with a portion thereof slightly backward from said clamp portion connected to a base;

a pair of stationary bits placed on said base near an end of said movable clamp portion of said oscillating arm and adjoining at a predetermined distance;

an oscillation driving mechanism attached to said backward portion of said oscillating arm and oscillating said oscillating arm horizontally in order to bend said blade material between said stationary bits and said movable clamp portion; and a feeding mechanism sending said blade material forward along said oscillating arm, wherein said feeding mechanism comprises:

a ball screw which is arranged along with said oscillating arm and rotates freely;

a blade material feeding member which fits on said ball screw and freely screws forward and backward and is attached to said oscillating arm and freely slides forward and backward; and a motor which is attached to said front end portion of said oscillating arm and rotates said ball screw.

13. The apparatus for bending blade material as set forth in claim 12, wherein said oscillation driving mechanism comprises:

a rack which is arc-shaped in a plane of projection and fixed on said base;

a pinion gear which is attached to said backward portion of said oscillating arm and gears with said rack; and a motor that rotates said pinion gear.

14. The apparatus for bending blade material as set forth in claim 12, wherein the feeding mechanism comprises:

a ball screw which is arranged along with said oscillating arm and rotates freely;

a blade material feeding member which fits on said ball screw and freely screws forward and backward and is attached to said oscillating arm and freely slides forward and backward; and a motor which is attached to said front end portion of said oscillating arm and rotates said ball screw.

15. The apparatus for bending blade material as set forth in claim 12, wherein a blade material guiding roller having a circumferential V-groove and fitting outside of an edge at an upper marginal end of said blade material and freely rolling and touching taper faces of said edge is attached to an end of said oscillating arm, and an opening angle of said circumferential V-groove of said blade material guiding roller is arranged to be smaller than an edge angle of said blade material.

16. The apparatus for bending blade material as set forth in claim 12, wherein said oscillation driving mechanism comprises:

a rack which is arc-shaped in a plane of projection and fixed on said base;

a pinion gear which is attached to said backward portion of said oscillating arm and gears with said rack; and a motor that rotates said pinion gear through an endless flex power transmission substance and rotators between which said transmission substance is suspended, wherein said motor is attached within a region between a center of said front end portion of said oscillating arm.

17. The apparatus for bending blade material as set forth in claim 12, wherein said oscillation driving mechanism comprises:

a blade material feeding member which is attached to said backward portion of said oscillating arm and freely rotates on said vertical axis;

a ball screw which screws into said blade material feeding member;

a pivot frame which supports said freely rolling ball screw and is placed on said base so that said pivot frame freely oscillates on said vertical axis; and a motor which rotates said ball screw.

18. The apparatus for bending blade material as set forth in claim 12, wherein a first guide rail which is arc-shaped in a plane of projection is placed on said base and passes under said backward portion of said oscillating arm, and a plurality of freely rolling guide rollers attached to said backward portion of said oscillating arm hold said first guide rail and freely roll touching said first guide rail.

19. The apparatus for bending blade material set forth in claim 18, wherein curvature finely regulating mechanisms which finely adjust a radius of curvature of said first guide rail are attached to first and second end portions of said first guide rail.

20. The apparatus for bending blade material as set forth in claim 18, wherein an oscillation angle of said oscillating arm is under control of absolute programming.

21. An apparatus for bending blade material comprises:

an oscillating arm having a movable clasp portion for freely fixing and releasing a strip-shaped blade material at said front end portion thereof and rotating freely on a vertical axis with a portion thereof slightly backward from said clamp portion connected to a base;

a pair of stationary bits placed on said base near an end of said movable clamp portion of said oscillating arm and adjoining at a predetermined distance;

an oscillation driving mechanism attached to said backward portion of said oscillating arm and oscillating said oscillating arm horizontally in order to bend said blade material between said stationary bits and said movable clamp portion;

a feeding mechanism sending said blade material forward along said oscillating arm; and a first guide rail which is arc-shaped in a plane of projection is placed on said base and passes under said backward portion of said oscillating arm, and a plurality of freely rolling guide rollers attached to said backward portion of said oscillating arm hold said first guide rail and freely roll touching said first guide rail.

22. The apparatus for bending blade material as set forth in claim 21 wherein said oscillation driving mechanism comprises:

a rack which is arc-shaped in a plane of projection and fixed on said base;

a pinion gear which is attached to said backward portion of said oscillating arm and gears with said rack; and a motor that rotates said pinion gear.

23. The apparatus for bending blade material as set forth in claim 21 wherein said feeding mechanism comprises:

a ball screw which is arranged along with said oscillating arm and rotates freely;

a blade material feeding member which fits on said ball screw and freely screws forward and backward and is attached to said oscillating arm and freely slides forward and backward; and a motor which is attached to said front end portion of said oscillating arm and rotates said ball screw.

24. The apparatus for bending blade material as set forth in claim 21, wherein a blade material guiding roller having a circumferential V-groove and fitting outside of an edge at an upper marginal end of said blade material and freely rolling and touching taper faces of said edge is attached to an end of said oscillating arm, and an opening angle of said circumferential V-groove of said blade material guiding roller is arranged to be smaller than an edge angle of said blade material.

25. The apparatus for bending blade material as set forth in claim 21 wherein said oscillation driving mechanism comprises:

a rack which is arc-shaped in a plane of projection and fixed on said base;

a pinion gear which is attached to said backward portion of said oscillating arm and gears with said rack; and a motor that rotates said pinion gear through an endless flex power transmission substance and rotators between which said transmission substance is suspended, wherein said motor is attached within a region between a center of said front end portion of said oscillating arm.

26. The apparatus for bending blade material as set forth in claim 21, wherein said oscillation driving mechanism comprises:

a blade material feeding member which is attached to said backward portion of said oscillating arm and freely rotates on said vertical axis;

a ball screw which screws into said blade material feeding member;

a pivot frame which supports said freely rolling ball screw and is placed on said base so that said pivot frame freely oscillates on said vertical axis; and a motor which rotates said ball screw.

27. The apparatus for bending blade material set forth in claim 21, wherein curvature finely regulating mechanisms which finely adjust a radius of curvature of said first guide rail are attached to first and second end portions of said first guide rail.

28. The apparatus for bending blade material as set forth in claim 21, wherein an oscillation angle of said oscillating arm is under control of absolute programming.

29. An apparatus for bending blade material comprising:

an oscillating arm having a movable mouth portion with a clearance through which a strip-shaped blade material is freely sent at a front end portion thereof and being attached to a base and rotating freely on a vertical axis that passes through a portion thereof slightly backward from said movable mouth portion;

a pair of stationary bits placed on said base near an end of said movable mouth portion of said oscillating arm and adjoining at a predetermined mutual space;

an oscillation driving mechanism attached to said backward portion of said oscillating arm and oscillating said oscillating arm horizontally in order to bend said blade material between said stationary bits and said movable mouth portion; and a feeding mechanism sending said blade material forward along said oscillating arm, wherein said feeding mechanism comprises:

a ball screw which is arranged along with said oscillating arm and rotates freely;

a blade material feeding member which fits on said ball screw and freely screws forward and backward and is attached to said oscillating arm and freely slides forward and backward; and a motor which is attached to said front end portion of said oscillating arm and rotates said ball screw.

30. The apparatus for bending blade material as set forth in claim 29, wherein rear inner faces of said stationary bits are arc-shaped in a plane of projection and front faces of said movable mouth portion corresponding to said rear inner faces of said stationary bits are provided with recessed portions at a left and right of clearance forward end portions where said blade material is fed.

31. An apparatus for bending blade material comprising:

an oscillating arm having a movable mouth portion with a clearance through which a strip-shaped blade material is freely sent at a front end portion thereof and being attached to a base and rotating freely on a vertical axis that passes through a portion thereof slightly backward from said movable mouth portion;

a pair of stationary bits placed on said base near an end of said movable mouth portion of said oscillating arm and adjoining at a predetermined mutual space;

an oscillation driving mechanism attached to said backward portion of said oscillating arm and oscillating said oscillating arm horizontally in order to bend said blade material between said stationary bits and said movable mouth portion; and a feeding mechanism sending said blade material forward along said oscillating arm, wherein a first guide rail which is arc-shaped in a plane of projection is placed on said base and passes under said backward portion of said oscillating arm, and a plurality of freely rolling guide rollers attached to said backward portion of said oscillating arm hold said first guide rail and freely roll touching said first guide rail.

32. The apparatus for bending blade material as set forth in claim 30, wherein rear inner faces of said stationary bits are arc-shaped in a plane of projection and front faces of said movable mouth portion corresponding to said rear inner faces of said stationary bits are provided with recessed portions at a left and right of clearance forward end portions where said blade material is fed.

* * * * *